US007287653B2

(12) United States Patent
Rhodes

(10) Patent No.: US 7,287,653 B2
(45) Date of Patent: Oct. 30, 2007

(54) APPARATUS FOR STORING BOTTLES

(76) Inventor: William Timaru Rhodes, 503/109 Darling Point Road, Darling Point (AU) NSW 2027

( * ) Notice: Subject to any disclaimer, the term of this patent is extended or adjusted under 35 U.S.C. 154(b) by 388 days.

(21) Appl. No.: 10/275,663

(22) PCT Filed: Apr. 19, 2002

(86) PCT No.: PCT/AU02/00493

§ 371 (c)(1),
(2), (4) Date: Nov. 8, 2002

(87) PCT Pub. No.: WO02/085160

PCT Pub. Date: Oct. 31, 2002

(65) Prior Publication Data

US 2003/0205544 A1 Nov. 6, 2003

(30) Foreign Application Priority Data

Apr. 20, 2001 (AU) ..... PR4529

(51) Int. Cl.
*A47B 73/00* (2006.01)

(52) U.S. Cl. ..... 211/74; D7/701

(58) Field of Classification Search ..... 211/74, 211/126.4, 128.1, 126.11, 126.12, 126.14; 206/140, 144, 139; D7/701, 707; D6/467
See application file for complete search history.

(56) References Cited

U.S. PATENT DOCUMENTS

| | | | | | |
|---|---|---|---|---|---|
| 3,830,417 | A | * | 8/1974 | Montesi | 294/143 |
| 3,902,270 | A | * | 9/1975 | Molenaar | 446/122 |
| 4,613,047 | A | * | 9/1986 | Bushyhead et al. | 211/55 |
| 4,660,727 | A | * | 4/1987 | Levine | 211/74 |
| D336,408 | S | * | 6/1993 | Tersch et al. | D7/619.1 |
| 5,927,984 | A | * | 7/1999 | Lin | 433/218 |
| 6,003,924 | A | * | 12/1999 | Nicol et al. | 296/37.6 |
| D421,370 | S | * | 3/2000 | Hints | D7/701 |
| D446,092 | S | * | 8/2001 | Cautereels | D7/701 |

FOREIGN PATENT DOCUMENTS

| | | |
|---|---|---|
| AU | 51915/96 | 11/1996 |
| DE | 44 14759 | 12/1994 |
| FR | 2161139 | 7/1973 |
| FR | 2335125 | 7/1977 |
| GB | 1330786 | 9/1973 |
| GB | 1604260 | 5/1978 |

* cited by examiner

*Primary Examiner*—Richard E. Chilcot, Jr.
*Assistant Examiner*—Jared W. Newton
(74) *Attorney, Agent, or Firm*—Madson & Austin

(57) ABSTRACT

A module for a structure for storing bottles includes an elongate member having opposite end portions which each have either a channel or ridge configured for connection with a respective ridge or channel of like modules and a body portion extending in a general axial direction, wherein each end portion extends in substantially opposite lateral directions from the axial direction.

14 Claims, 11 Drawing Sheets

APPARATUS FOR STORING BOTTLES

FIELD OF THE INVENTION

The present invention relates to structures which are formed by connecting preformed modules together.

The present invention has a particular application for storage structures such as racks for storing bottles.

According to one application of the invention modules in accordance with the present invention may be connected together to form a wine rack.

BACKGROUND OF THE INVENTION

Many different types of wine racks are currently available and many of these involve wooden structures with specially shaped shelving to support wine bottles. The problem with many wine racks is that they are made with a specific number of receptacles for wine bottles. Therefore according to one scenario as a wine collection is increased it is necessary to buy additional wine racks which may cause problems with available space for addition of these extra wine racks.

According to another scenario a person may buy an extra large wine rack and eventually fill this rack over a period of time. In the interim valuable space may be taken up without any wine being stored in the wine rack.

U.S. Pat. No. 4,660,727 discloses one type of modular wine rack which is formed from two unitary frames which are connected together to form a number of interposing receptacles for bottles.

DISCLOSURE OF THE INVENTION

According to one embodiment of the present invention it is desirable to provide a wine rack which may be constructed from modules.

According to one aspect of the present invention there is provided a module for a structure, the module comprising an elongate member having opposite end portions which each have a connection means suitable for connection with connection means of like modules and a body portion extending in a general axial direction, wherein each end portion extends in substantially opposite lateral directions from the axial direction.

The body portion may be substantially planar.

It is preferred that each end portion is substantially planar.

It is preferred that the structure is a wine rack.

It should be understood that planar is intended to cover thin, generally flat panel like structures of any configuration.

Planar is also intended to cover mesh or grid like patterns which form a frame which is generally much thinner than it is wide or long.

Preferably each end portion is arcuate in shape.

The body portion is preferably wide and long compared to its thickness.

Each end portion may be arcuate in shape.

It is preferred that the connection means comprises a connection portion.

Preferably the connection means at one end of the module comprises a male portion and the connection means at the other end comprises a female portion.

It is preferred that the male portion comprises an enlarged lip or edge wall.

The female portion preferably comprises a slot formed in a bifurcated edge portion of the end portion.

The slot may be formed along the outermost edge of one end of the module.

Preferably the bifurcated edge portion comprises arcuate branches or bifurcations.

The slot preferably has a narrow opening.

The bifurcated edge portions preferably converge.

The module may have coupling means located between ends of the module for coupling with like coupling means of another module.

The module preferably has upper and lower faces.

Preferably the module has coupling means for coupling upper and/or lower faces of the module to upper and/or lower faces of a like module respectively.

The coupling means may comprise coupling portions.

Preferably the coupling portions comprise spigots or ridges or lugs or the like.

It is preferred that the shape of the module is S-shaped, or wave-like or sinusoidal.

The module may have additional structures on each of its faces. It is preferred that one coupling portion is located near one end of the module and the other coupling portion is located near the other end of the module on the opposite face thereof.

It is preferred that each coupling portion is located close to the start of end portions of each module, where each end portion is defined by a curved wall extending from the body portion.

According to another aspect of the present invention there is provided an apparatus for storing bottles comprising a plurality of components which are connectable together, each component having first and second ends each with respective first and second end connection means, wherein a first end connection means of one component is adapted to be connected to a second end connection portion of another component whereby a plurality of components are adapted to be connected together to form one or more enclosures for storage of bottles.

It is preferred that two components when connected together form an enclosure for at least one bottle.

Preferably each component has substantially the same shape.

Each component may comprise a plurality of parts.

Each component preferably has a coupling means for coupling with a coupling means of an adjacent component.

The coupling means preferably includes at least one coupling portion.

It is preferred that there are two coupling portions.

According to one embodiment there may be a plurality of coupling portions.

The coupling means preferably includes upper and lower coupling portions which are adapted to couple with matching coupling portions of one or more other components.

At least one component comprises an elongate member.

It is preferred that at least one component has a generally flat or planar configuration.

The elongate member may be generally planar with a predetermined shape.

Each component preferably has curved or arcuate portions.

Each component is preferably arcuate in shape.

Each component may be S-shaped.

It is preferred that opposite ends of the component face in opposite lateral directions.

Preferably each component has one end which is directed upwardly and the other end is directed downwardly.

The coupling means may include an upper coupling part located near one end of the component and a lower coupling part located near the opposite end.

The upper coupling part may be located near the other end which is directed downwardly.

It is preferred that when two components are connected together they form an enclosure therebetween which is adapted to receive and support a bottle.

According to another aspect of the present invention there is provided a frame for storing bottles comprising a plurality of modules with each module connected end to end with an adjacent module.

It is preferred that coupling portions of each module are adapted to abut a coupling portion of an adjacent module.

The words "comprising, having, including" should be interpreted in an inclusive sense, meaning that additional features may also be added.

BRIEF DESCRIPTION OF THE DRAWINGS

Preferred embodiments of the present invention will now be described by way of example only with reference to the accompanying drawings in which.

DETAILED DESCRIPTION OF THE DRAWINGS

Figure 1:
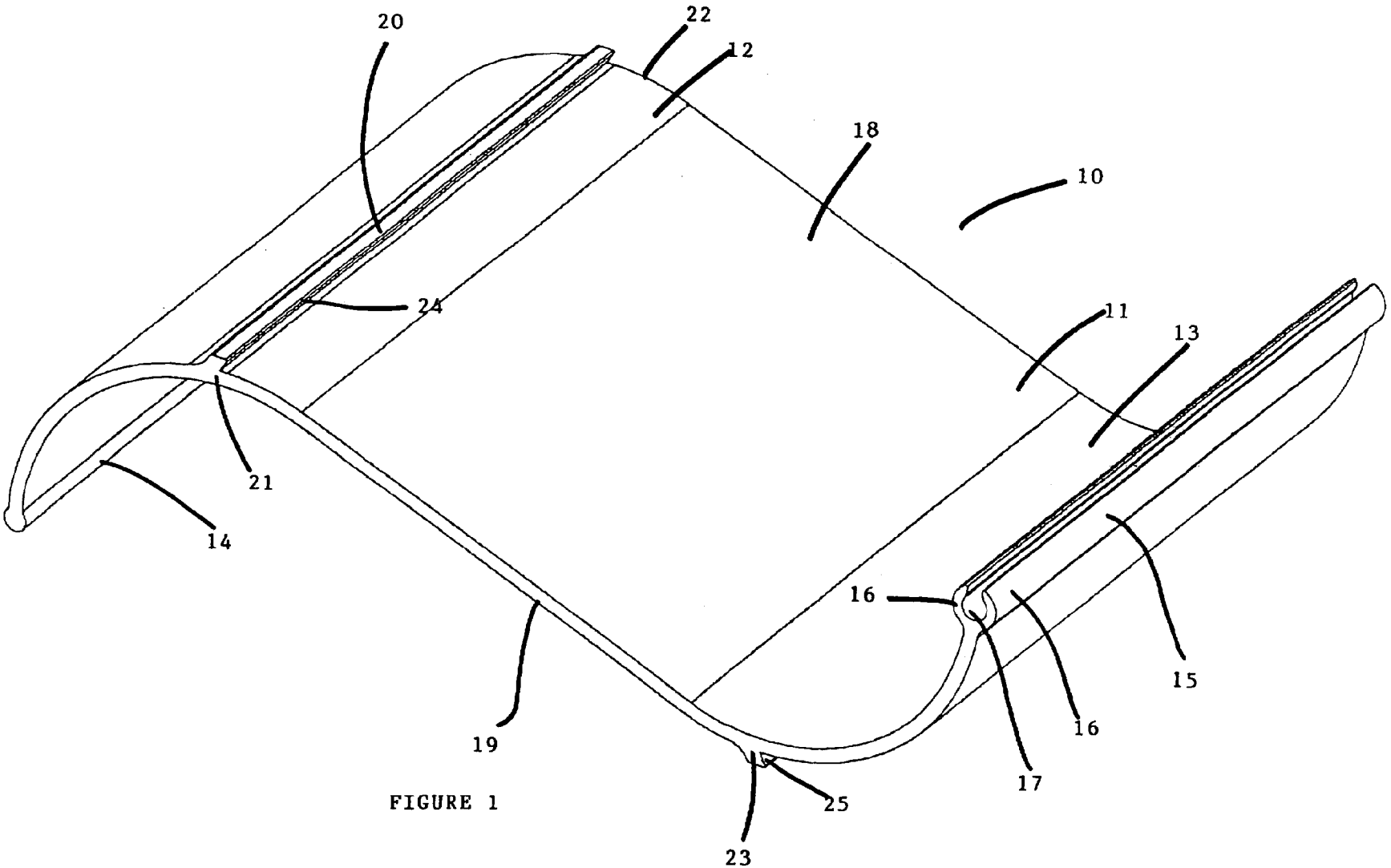
FIG. 1 shows a module according to a first embodiment of the present invention.

As shown in FIG. 1 a module according to the preferred embodiment of the invention consists of a curved laminar element made of any suitable material such as wood, plastic or metal. The sides of the element are parallel and the ends are perpendicular to the sides.

The module 10 has a wavy S-like shape consisting of a central rectangular section 11 of similar length and width and panel-like thickness.

One end of the central section 11 curves downwardly through an arcuate section 12 and the other end curves upwardly through a similar arcuate section 13.

Arcuate section 12 has its end edge 14 provided with a straight rounded rim 14 with the thickness of the rim being slightly larger than the thickness of the overall module 10.

At the opposite end of the module the arcuate section 13 has a straight edge 15 which is bifurcated to form converging rounded branches 16. The ends of the branches 16 define a narrow opening 17 which opens to a rounded channel having a matching interior shape to the exterior shape of the rim 14. Thus a rim 14 of one module is able to fit into the channel 17 of another module by sliding engagement from one side of the channel 17.

The angle or curvature of each section 12, 13 is more than one quarter of the circumference of a circle or half of a semi-circle.

The module 10 has an upper face 18 and a lower face 19. Approximately one quarter of the way along the curved section 12 a ridge 20 extends from one side edge 21 of the module to the opposite side edge 22.

The ridge 20 is perpendicular to the longitudinal axis of the module 10.

The ridge 20 has a thickness similar to that of the overall module 10 and is slanted slightly towards the central section 11.

In a similar fashion curved section 13 has a ridge 23 on its lower surface, again at approximately one quarter of the distance from the edge of the central section 11 to the edge 15.

The ridge 23 is slightly slanted away from the central section 11.

Figure 2:
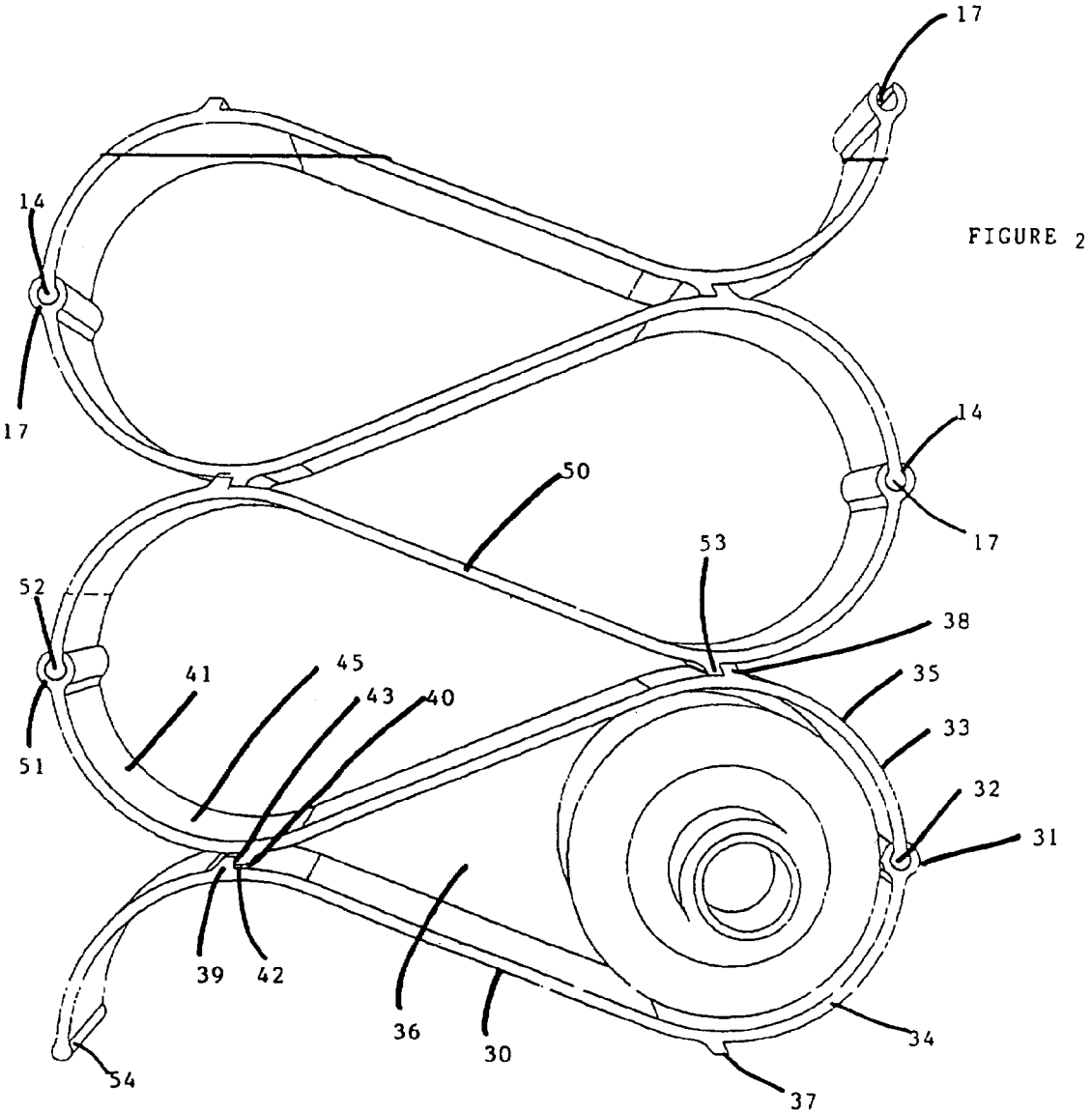
FIG. 2 shows a front view of a wine rack formed from modules as shown in FIG. 1.
Figure 3:
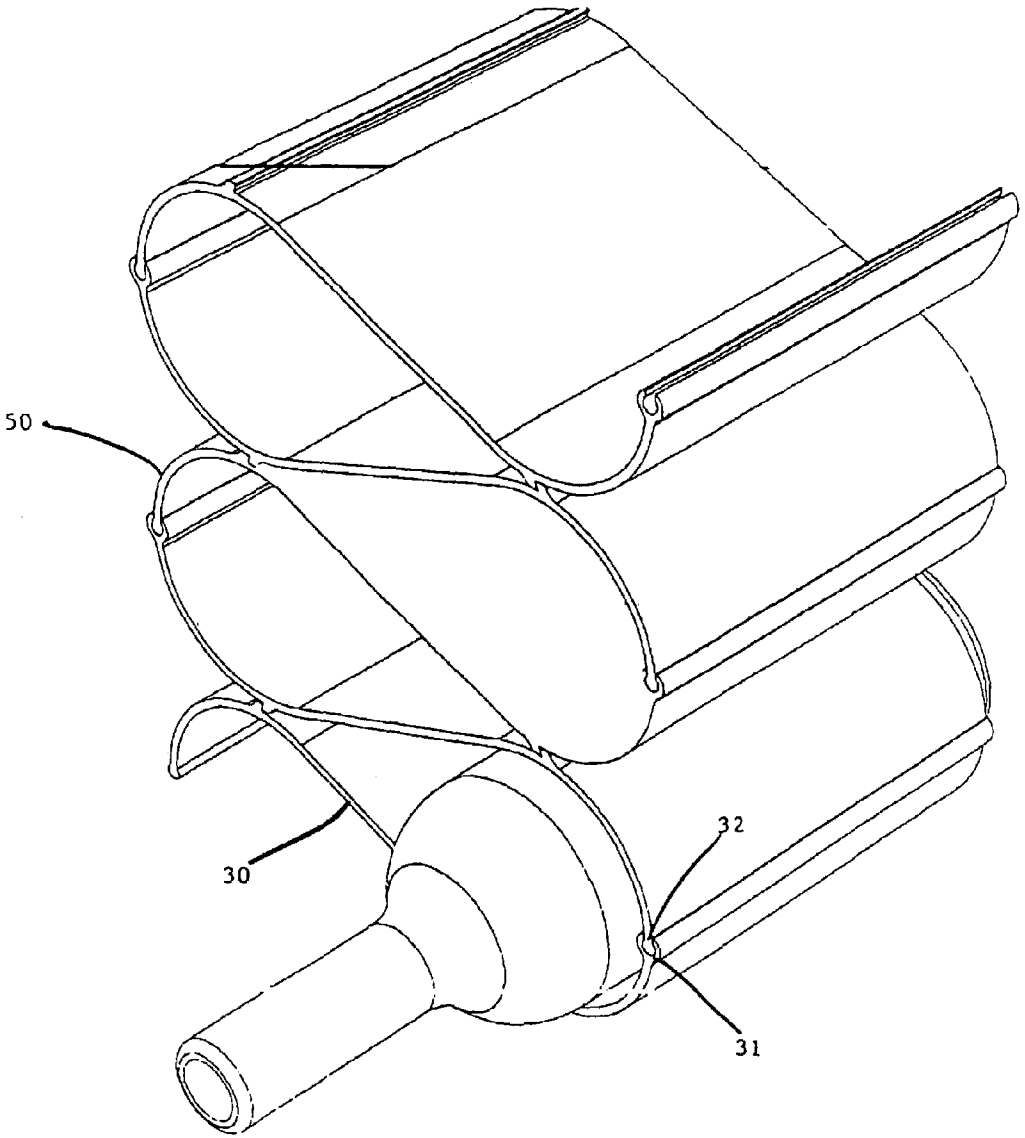
FIG. 3 shows an angled view of the wine rack shown in FIG. 2.

As shown in FIG. 2 a number of modules 10 can be connected together end to end by connecting the rim 14 into the channel 17.

Because of the shape of the module 10 when two modules are connected end to end the ridges 20 and 23 engage with matching ridges of an adjacent module 10 and thus, ridges 20 and 23 are base portions for supporting part of the module.

Thus in FIG. 2 a bottom module 30 has its channel 31 connected with a rim 32 of another module 33.

The combined curvature of curved section 34 of module 30 which is provided with the channel 31 at its end and curved section 35 having the rim 32 at its end result in an enclosure 36 being created between adjacent modules 30 and 33.

This enclosure 36 is formed because the curvature of sections 34 and 35 is greater than the curvature of a semi-circle and is able to support a bottle.

It is preferred if modules are identical that the curvature of each of the sections 34 and 35 is greater than the curvature of half a semi-circle and is sufficient so that the central section of two modules when connected together converge.

In the preferred embodiment it is noted that as shown in FIG. 2 ridge 37 located on the lower face of curved section 34 is vertically aligned with ridge 38 on the upper surface of curved section 35.

It follows that the angle of curvature from a ridge to the end edge of a curved section preferably corresponds to half of a semi-circle.

It follows therefore that the distance of the ridge to the adjoining central section determines the angle at which central sections of connected modules converge.

It is noted that the position of the ridges may be changed so that they are not vertically aligned in the above manner. However for stability reasons having the ridges vertically aligned results in a more stable wine rack assembly.

Still referring to FIG. 2 it is noted that the other curved region of module 30 has its ridge 39 on its upper surface engaging with ridge 40 on the lower surface of arcuate section 41 of module 33. Thus, ridges 39 and 40 are base portions that support part of the modules 30 and 33.

It is noted that the ridges 39 and 40 engage by the inner edge 42 of ridge 39 abutting the outer edge 43 of ridge 40.

In FIG. 1 the inner edge 42 would correspond with inner edge 24 of ridge 20 and the outer edge 43 would correspond with outer edge 25 of ridge 23.

The engagement of ridges 39 and 40 prevent module 33 from moving to the left and at the same time provide support for anything located on top of the upper face 45 of module 33.

Another module 50 may be connected to module 33 in a similar fashion to that previously described regarding modules 30 and 33, so that in contrast to modules 33 and 30 an enclosure is created to the left of the centre of each central section of modules 30 and 33 instead of to the right thereof. Channel 51 of module 33 and ridge 52 of module 50 engage in the manner previously described. Likewise ridge 38 of module 33 and ridge 53 of module 50 engage in the same fashion as ridges 39 and 40.

Rim 54 and ridge 37 of module 30 provide the support points for the assemblage of modules. Depending upon the number of bottles that need to be stored in the assemblage additional modules may be continuously added, thus moving the assemblage upwardly creating a serpentine path of modules with symmetrically arranged enclosures formed between adjacent modules.

By changing the shape of the modules the shape of the enclosures may be changed and it is possible for each enclosure to support more than one bottle.

According to a variation of the present invention each module has surface structures such as walls which are able to separate bottles supported on the same surface of a module.

According to another variation each module has a number of serpentine curves which create a number of enclosures when two modules are connected together.

According to another embodiment of the invention the ridges may be replaced by holes through the module which are able to receive fastening devices.

Figure 4:
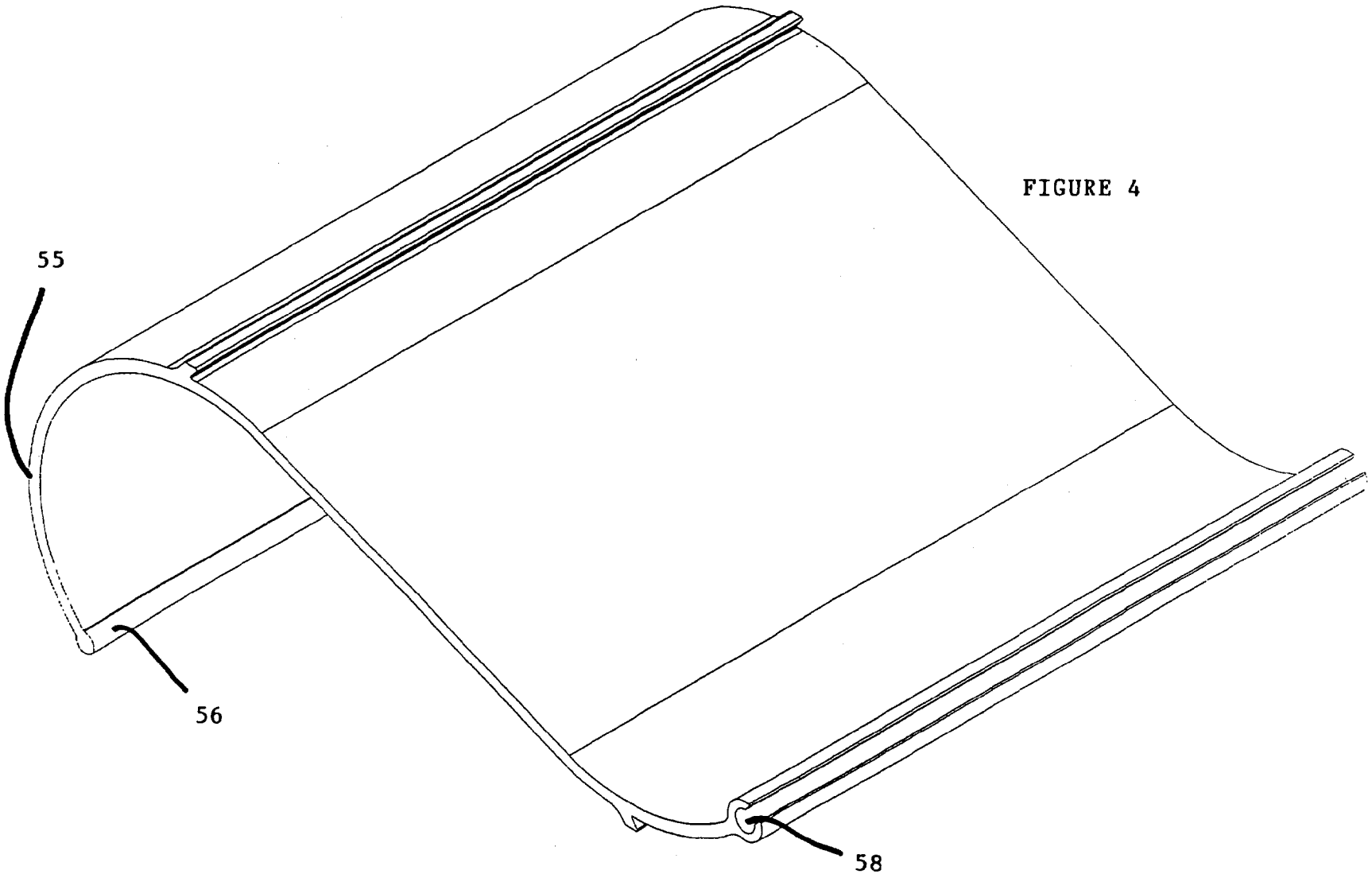
FIG. 4 shows an angled view of a module according to a second embodiment of the present invention.

A module according to the second embodiment of the present invention as shown in FIG. 4 is very similar to the module of the first embodiment, except that lower arcuate section 55 has a larger angle of curvature and consequently at its lower end rim 56 curves inwardly. In the first embodiment corresponding arcuate section 39 had rim 54 at its outer end angled slightly outwardly, although almost downwardly vertically.

Because arcuate section 55 has a greater angle of curvature the corresponding upper arcuate section 57 has a smaller angle of curvature in direct proportion to the increase in angle of curvature for arcuate section 55.

Figure 5:
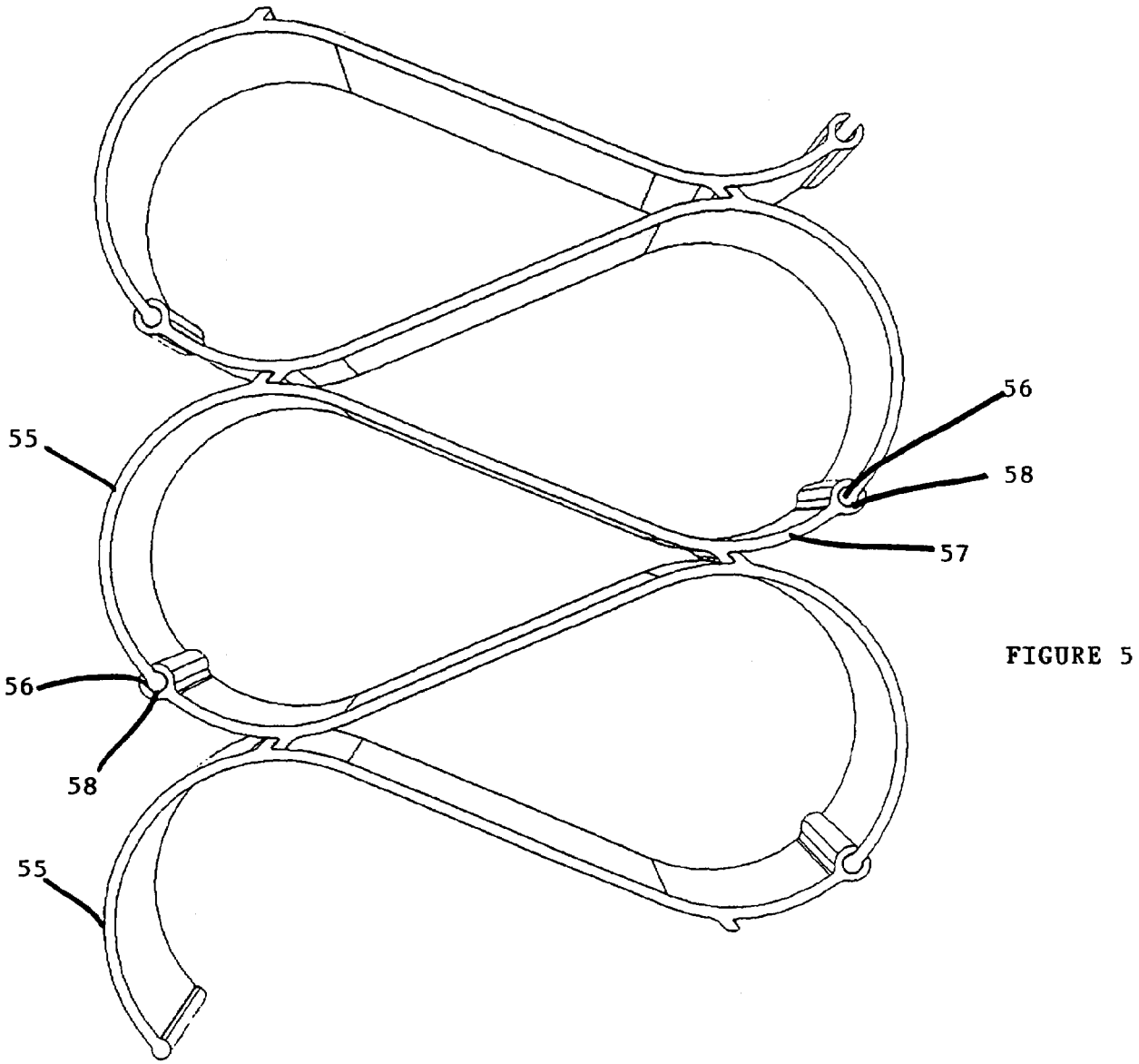
FIG. 5 shows a wine rack formed from modules as shown in FIG. 4.

Thus as shown in FIGS. 4 and 5 the upper arcuate section 57 is very short and extends outwardly at approximately 45° to horizontal. Channel 58 at its outer end couples with the rim 56.

The second embodiment exemplifies how the arcuate sections at each end of the module may vary in length and curvature.

Figure 6:
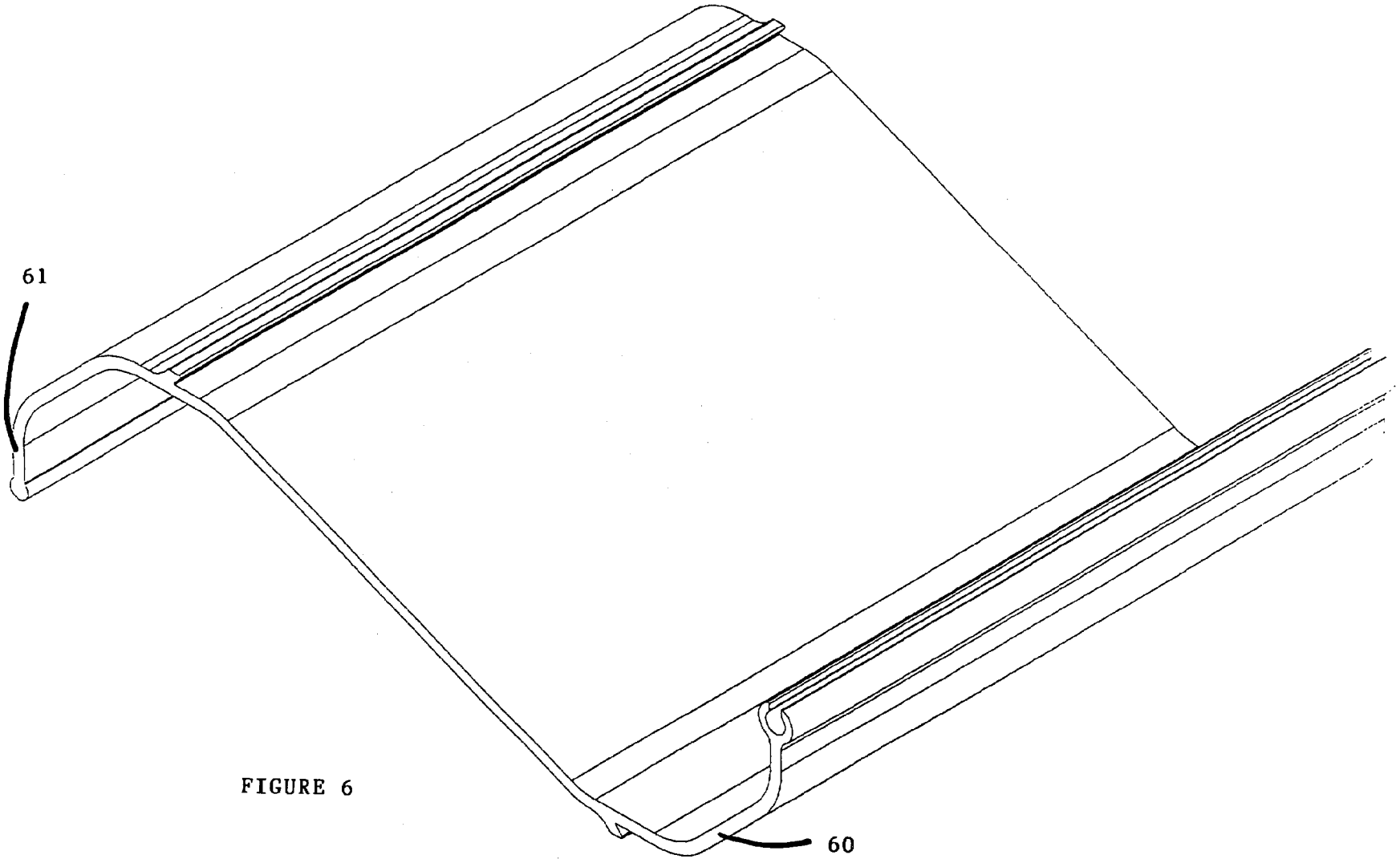
FIG. 6 shows an angled view of a module according to a third embodiment of the present invention.
Figure 7:
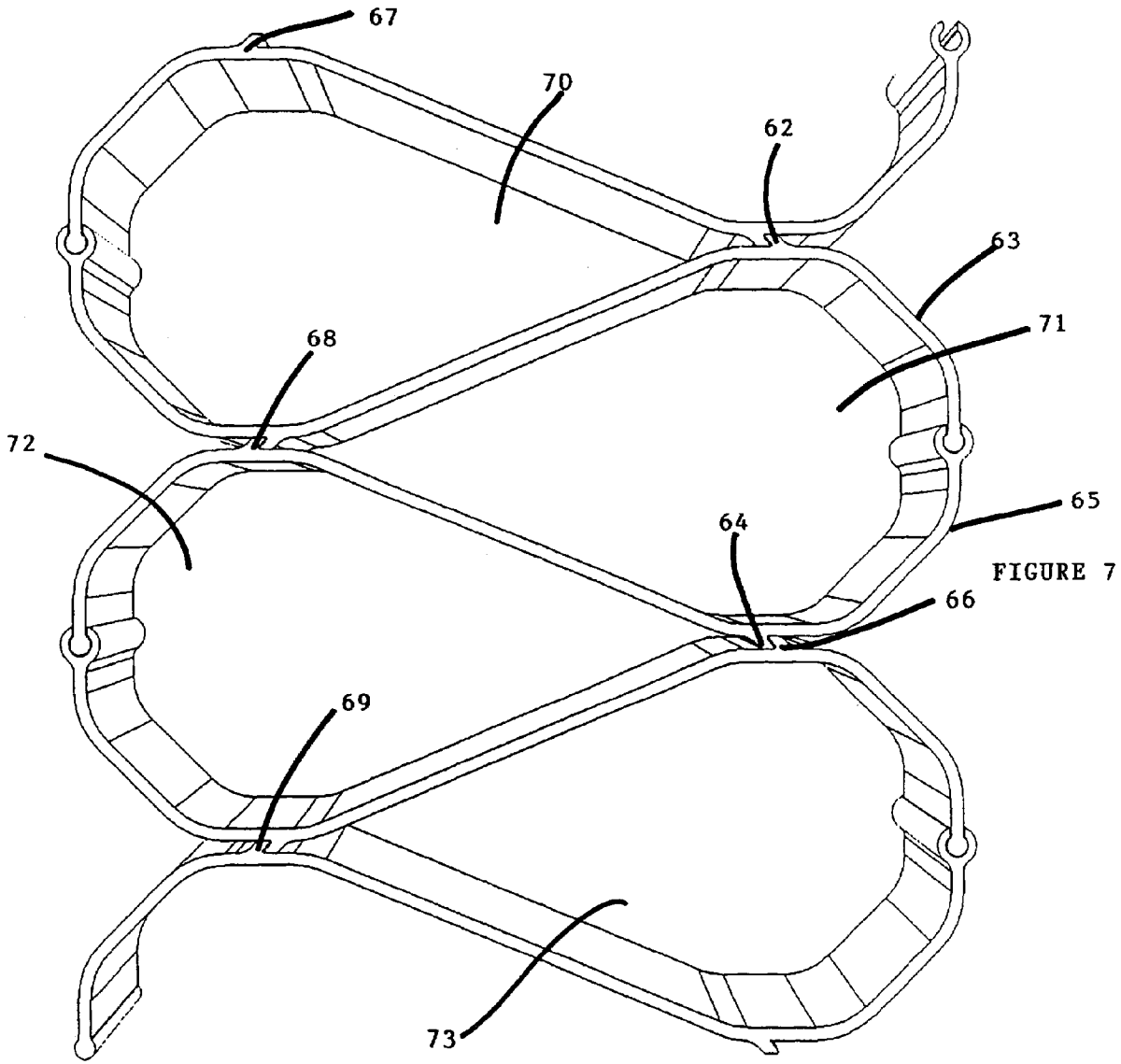
FIG. 7 shows a wine rack made from modules shown in FIG. 6.

The third embodiment of the present invention shown in FIGS. 6 and 7 exemplifies how the shape of the module according to the present invention may change. Accordingly in the third embodiment of the invention the arcuate sections of the first two embodiments are replaced by irregular shaped upper and lower curved sections 60, 61. Typically the upper section 60 when coupled to a lower section 61 of another module results in the combined sections covering a curvature of 180° approximately from ridge 62 of one module 63 to ridge 64 of the module 65 to which it is coupled. In fact like ridges 62, 66 of modules on one side of the wine rack are generally vertically aligned as are like ridges on the other side of the wine rack 67, 68, 69.

It should be noted from the above that individual modules may be broken into smaller and smaller parts. However the assembled wine rack is formed from a series of modules which together form a serpentine path which forms series of aligned openings on left and right hand sides of the wine rack. The size and shapes of the openings 70, 71, 72, 73 may vary depending upon the curvature and general shape of each module when coupled with an adjacent module.

Figure 8:
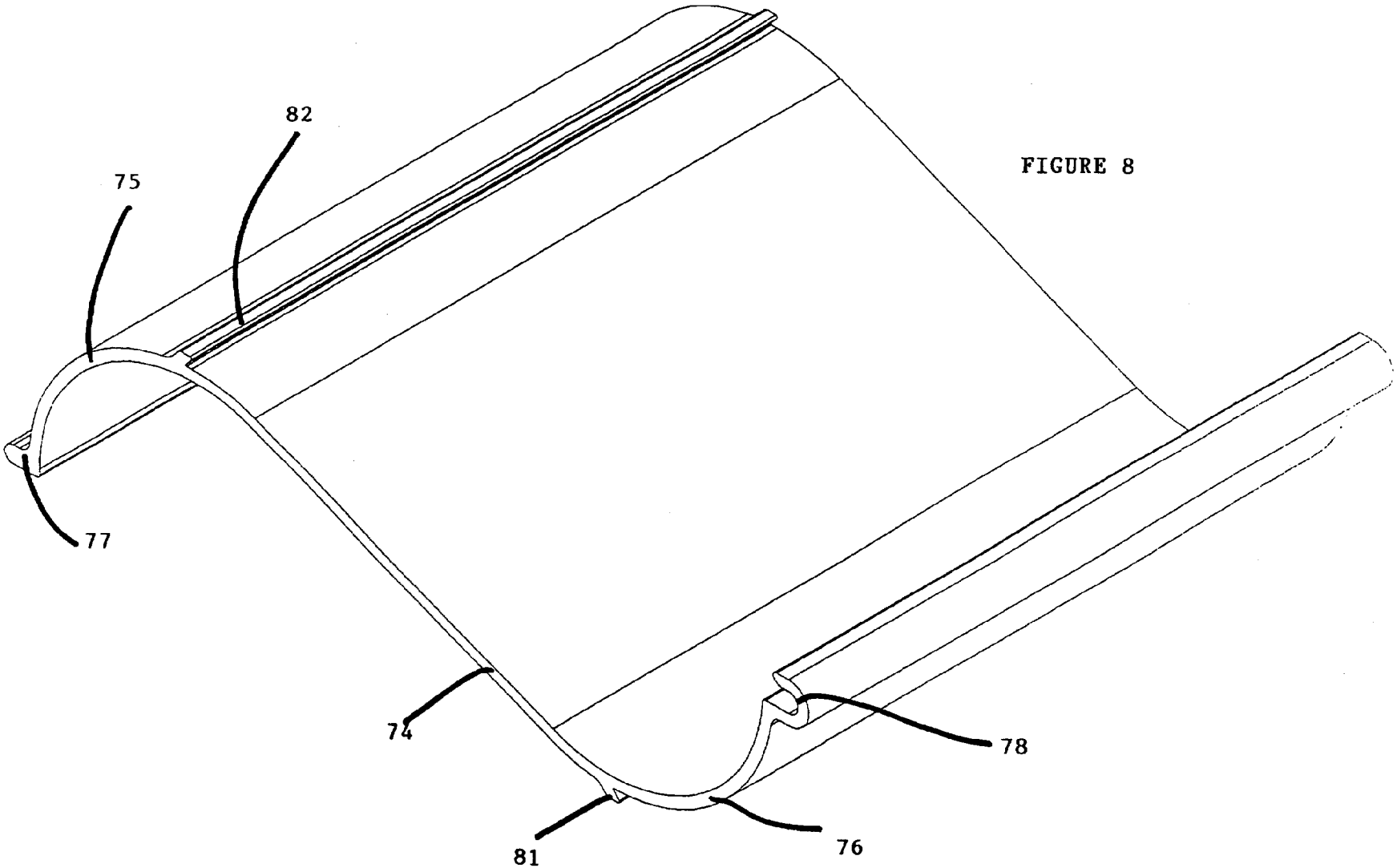
FIG. 8 shows an angled view of a module according to a fourth embodiment of the present invention.
Figure 9:
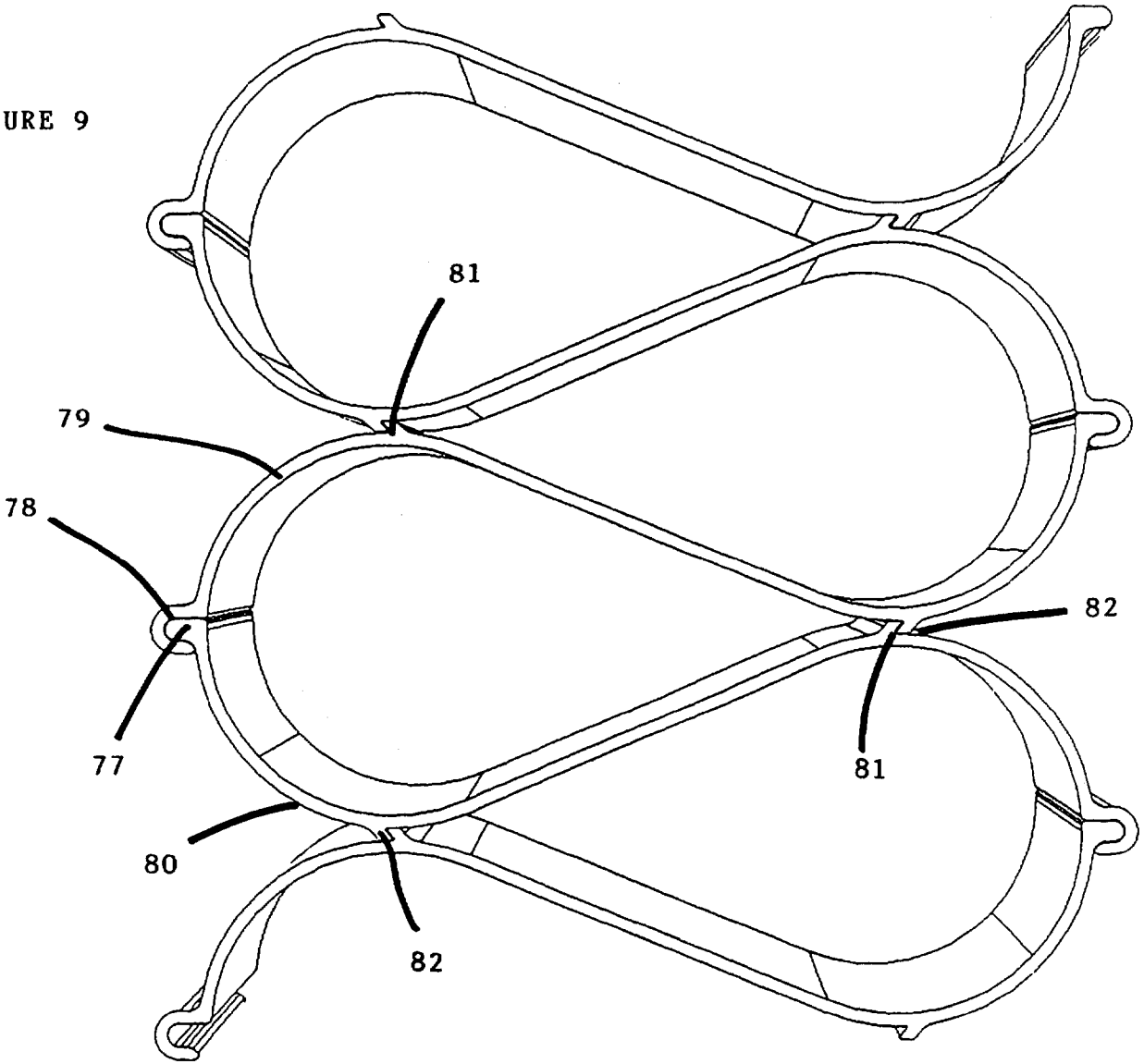
FIG. 9 shows a wine rack made from modules shown in FIG. 8.

FIGS. 8 and 9 show a module according to a fourth embodiment of the present invention which approximates a sine wave in shape. One module 74 shown in FIG. 8 differs from previous modules because the ends of each arcuate section 75, 76 are provided with a different shaped coupling portion 77, 78 respectively.

End portion 77 of the lower arcuate section 75 consists of an outwardly extending lip whereas the end portions 77 of the upper arcuate section 76 is provided with an inwardly facing channel of the same shape as the lip 77.

Each arcuate section 75, 76 curves through an angle of approximately 45° so that when like modules are connected together as in FIG. 9, end portions 77 and 78 couple at approximately the mid point between the upper and lower extremities of the coupled modules 79, 80. Furthermore the lower end 77 is approximately aligned with the lower ridge 81 of the same module. Likewise the upper end 78 is horizontally aligned with the upper ridge 82 of the same module.

A fourth embodiment of the present invention thus provides a wine rack with a symmetric arrangement of modules, with coupled ends being substantially horizontally aligned with coupled ridges of the same pair of coupled modules.

Figure 10:
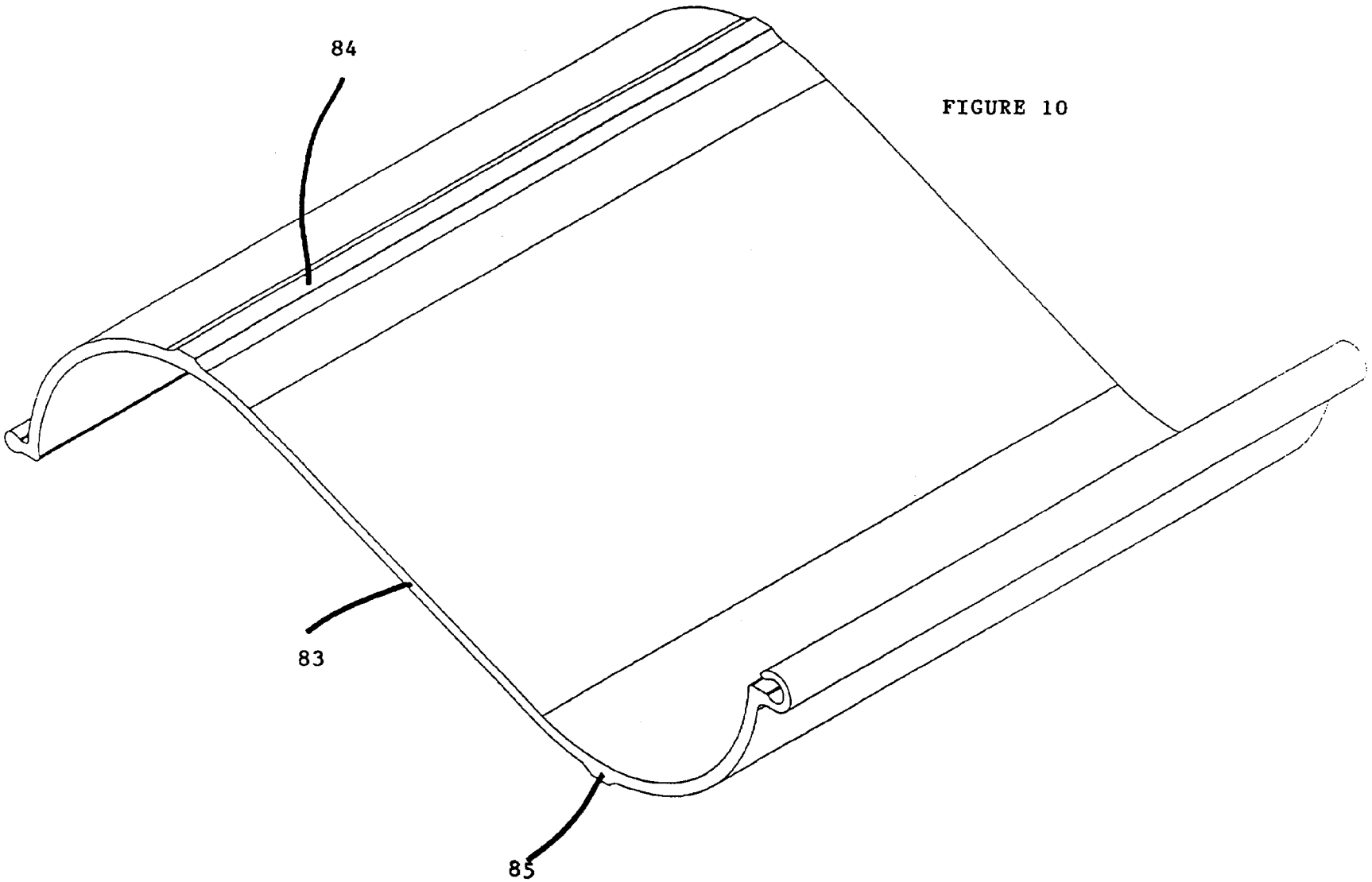
FIG. 10 shows an angled view of a module according to a fifth embodiment of the present invention.
Figure 11:
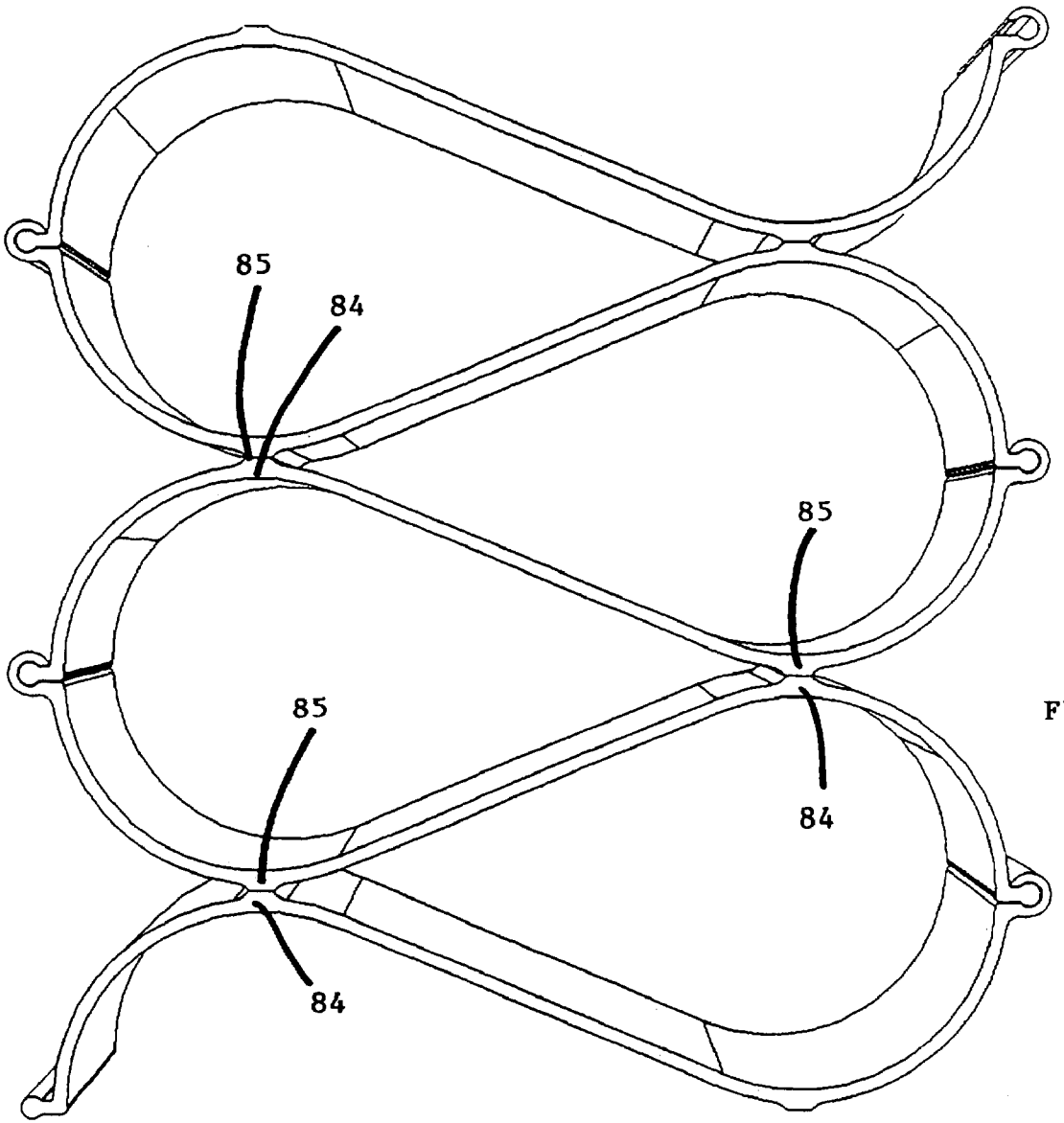
FIG. 11 shows a wine rack from modules as shown in FIG. 10.

According to the fifth embodiment of the present invention coupling between adjacent ridges of coupled modules may be modified. Thus as shown in FIG. 10 a module 83 is provided with upper and lower ridges 84, 85 which each decrease in width to an apex which is a flat horizontal plateau. Thus as shown in FIG. 11 ridges of adjacent coupled modules instead of hooking together abut bottom face to top face with one on top of the other.

In the fifth embodiment it is preferred that the modules are modified versions of the fourth embodiment of the present invention.

It is noted that the size and width of the ridges in the fifth embodiment of the present invention may vary to provide greater or lesser surface area contact between adjacent ridges 84, 85.

According to another embodiment of the present invention a wine rack is made from modules which when connected together provide a ribbon like serpentine path which creates substantially identical openings which are adapted to receive bottles, such as bottles of wine. It is preferred that the openings are substantially pear or tear drop shape.

It is preferred that the wine rack consists of a series of left and right side openings formed by coupled pairs of modules. Each of the pairs of openings are aligned vertically along with left and right side ridges 84, 85. The height of the overall wine rack will be determined by the overall stability of the structure which is thus formed.

According to one embodiment of the invention a base plate may be provided with coupling portions to enable the lowermost module to be coupled thereto.

It is to be understood that, if any prior art publication is referred to herein, such reference does not constitute an admission that the publication forms a part of the common general knowledge in the art, in Australia or in any other country.

The invention claimed is:

1. A bottle support comprising modules, each module having a substantially S-shaped structure and comprising:

an elongate member having a planar rectangular body portion between a first arcuate end portion curving in a first direction, and a second arcuate end portion curving in a second direction opposite of said first direction, said first arcuate end portion having a first connecting portion and said second arcuate end portion having a second connecting portion, wherein said first connecting portion is configured to connect with said second connecting portion of another like module to form enclosures for bottles.

2. A bottle support as in claim 1, wherein adjacent modules are oriented in opposite directions.

3. A bottle support as in claim 1, wherein the first connecting portion comprises a male portion.

4. A bottle support as in claim 3, wherein the second connecting portion comprises a female portion.

5. A bottle support as in claim 4, wherein the female portion has a slot and the male portion has an enlarged lip which is configured to couple with the slot of the female portion.

6. A bottle support as in claim 1, further comprising a ridge attached to each module.

7. A bottle support as in claim 6, wherein the ridges on adjacent modules interlock to inhibit lateral displacement of the modules.

8. A bottle support as in claim 1, wherein the modules are constructed such that connecting adjacent modules together produces a tear-drop shaped enclosure for bottles.

9. A bottle support as in claim 1, wherein the first arcuate end portion and a second arcuate end portion are formed by irregular shaped sections.

10. The apparatus as claimed in claim 1 wherein the first and second end portions extend in upper and lower directions respectively.

11. The apparatus as claimed in claim 1 wherein the coupled modules define a structure having a serpentine shape.

12. The apparatus as claimed in claim 1, wherein when adjacent modules are connected together, a plurality of left and right side enclosures for storage bottles are formed, wherein each of the left and right side enclosures are aligned vertically with other left and right side enclosures respectively.

13. The apparatus as claimed in claim 12 wherein each enclosure is formed by opposing faces of two coupled modules.

14. The apparatus as claimed in claim 13 comprising a stack of coupled modules forming a plurality of loops defining respective enclosures.

* * * * *